United States Patent [19]

Mills

[11] Patent Number: 4,934,536

[45] Date of Patent: Jun. 19, 1990

[54] ENVELOPE ASSEMBLY

[75] Inventor: Larry E. Mills, Westchester, Ohio

[73] Assignee: Bedinghaus Business Forms, Inc., Cincinnati, Ohio

[21] Appl. No.: 286,277

[22] Filed: Dec. 16, 1988

[51] Int. Cl.[5] ..... B65D 27/34; B65D 27/36

[52] U.S. Cl. ..... 206/610

[58] Field of Search ..... 206/610; 229/69

[56] References Cited

U.S. PATENT DOCUMENTS

| | | | |
|---|---|---|---|
| Re. 30,114 | 10/1979 | Juszak et al. . | |
| 3,941,307 | 3/1976 | Van Malderghem . | |
| 4,095,695 | 6/1978 | Steidinger | 206/610 |
| 4,157,759 | 6/1979 | Dicker | 206/610 |
| 4,166,539 | 9/1979 | Allen et al. . | |
| 4,193,501 | 3/1980 | Allen . | |
| 4,586,611 | 5/1986 | Scalzo | 206/610 |
| 4,775,094 | 10/1988 | Eisele | 229/69 |

*Primary Examiner*—Stephen P. Garbe

*Attorney, Agent, or Firm*—Wood, Herron & Evans

[57] ABSTRACT

An envelope assembly formed from a series connection of such envelope assemblies has a closed outer envelope formed from two outer plies sealed along at least three marginal edges by non-releasable glue, one of the plies having a removable pull tab along a fourth marginal edge. Insert material held in registration within the closed outer envelope is unattached to the outer envelope along its four marginal edges, and includes at least a return envelope. One of the plies forming the return envelope has a foldable flap for sealing the return envelope, while the other of the plies forming the return envelope has a waste flap secured to one of the outer plies by non-releasable glue. The waste flap holds the insert material in registration with the outer envelope, but is detachable from the insert material along a line of weakening, thus remaining within the outer envelope when the remainder of the insert material is extracted therefrom.

7 Claims, 2 Drawing Sheets

ENVELOPE ASSEMBLY

Field of the Invention

This invention relates to an envelope assembly, and more particularly to an envelope assembly which is detachable from a succession of envelope assemblies manufactured in series connected form.

Background of the Invention

In the mass manufacturing of envelope assemblies in series connected form, it is important that the structure be as simple as possible in order to reduce confusion on the part of customers receiving the outer envelopes. For instance, in several known envelope assemblies, the insert material has a foldable flap for sealing the return envelope and a removable waste flap which abuttingly engages the foldable flap prior to sealing. If the foldable flap is inadvertently removed, instead of the waste flap, the return envelope must be sealed in another manner.

Accordingly, U.S. Pat. No. 3,941,307 and U.S. Re 30,114 disclose snap opening envelope assemblies in which the waste flap of the inner envelope is retained within the outer envelope upon extraction of the insert material These envelope assemblies are snap opened by detaching a tear strip several plies thick from the side of the outer envelope Each of the plies forming the tear strip are separable along a perforated line of weakening. Thus, fabrication of the tear strip requires perforating all of the tear strip plies along the marginal edge of opening of the assembly.

Another aspect of receiver confusion with envelope assemblies of this type relates to initial opening of the outer envelope. U.S. Pat No. 4,166,539 and U.S. Pat. No. 4,193,501 disclose envelope assemblies manufactured from a succession of series connected envelope assemblies in which each assembly is designed to simulate a folded flap envelope These envelope assemblies are top opening, or open along an edge which is transverse with respect to the continuous webs from which the succession of envelope assemblies are manufactured. These patents do not disclose return of the waste flap in the return envelope.

While the above mentioned patents disclose envelope assemblies which may reduce receiver confusion of one manner or another, they are susceptible to another problem inherent with such envelope assemblies, a problem caused by the necessity of keeping the insert material and the outer envelope in registration in order to imprint upon the enclosed return envelope simultaneously with addressing of the outer envelope Each of the above described patents discloses a multiple construction along at least one of the marginal edges of the envelope assembly in order to maintain registration. Because of increased thickness due to multiple plies at a marginal edge, it sometimes becomes difficult to run the continuous envelope assembly through computer operated printers.

It is an object of this invention to provide an envelope assembly formed from a series connection of envelope assemblies which facilitates feeding of the envelopes through a computer printer, while at the same time minimizes the opportunity for receiver confusion.

Summary of the Invention

To these ends, according to a preferred embodiment of the invention, an envelope assembly formed from a number of longitudinally extending webs comprises two outer plies glued along at least three marginal edges, and one of the plies having a removable pull tab along a fourth, separate, marginal edge. The pull tab enables the outer envelope to be opened. Insert material including at least an open, return envelope is secured within the outer envelope but unattached to the outer envelope along its marginal edges. The return envelope has a foldable flap to seal the return envelope and a waste flap abutting the foldable flap, the waste flap being defined by a weak perforation line and secured to one of the plies forming the outer envelope by a stream of non-releasable glue, thereby holding the inner and outer envelopes in registration. After the outer envelope has been opened by removing the pull tab, pulling of the insert material from the outer envelope causes the waste flap to detach along the weak perforation line and to remain within the outer envelope.

The pull tab provides easy opening of the outer envelope and is easy to manufacture, requiring perforation and slitting of only one of the outer plies. Preferably, the pull tab is formed along one of the marginal edges of the envelope assembly which extends transverse to the longitudinal direction of the webs forming the series connected envelopes, thus providing an envelope assembly having a shape resembling a standard top opening envelope According to a first preferred embodiment of the invention, the pull tab is defined in one of the outer plies by a first tear line parallel to the fourth marginal edge, a second tear line between the first tear line and the fourth marginal edge, and a U-shaped slot. Preferably the tear lines are parallel. Each leg of the U-shaped slit is aligned with one end of a tear line. A line of non-releasable glue secures the outer plies together along the fourth marginal edge and extends parallel to and between the second tear line and the fourth marginal edge. Opening of the outer envelope is accomplished by grasping a portion of the outer ply defined by the U-shaped slit and pulling transversely to the envelope assembly to detach the pull tab along the first and second tear lines.

According to a second preferred embodiment of the invention, the pull tab is defined in one of the outer plies by a first tear line parallel to the fourth marginal edge and an L-shaped slit, with one leg of the L-shaped slit aligned with the tear line. A line of releasable glue secures the outer plies together along the fourth marginal edge, but is releasable upon removal of the pull tab.

While a one ply pull tab simplifies manufacture of the envelope assembly and results in an easy to open outer envelope that is not likely to confuse customers, the connected waste flap also provides advantages. The use of non-releasable glue to connect the waste flap to one of the outer plies and to hold the inner and outer envelopes in registration reduces the multiple layering effect along the marginal edges of the envelope assembly, thus facilitating feeding of the series connected envelope assemblies through a computer printer. Moreover, because the waste flap is detachable from the insert material along a weak perforation line, it remains within the outer envelope upon extracting the insert material, thus preventing inadvertent detachment of the foldable flap.

These and other features of the invention will be more readily understood in view of the following detailed description and the drawings in which:

Figure 1:
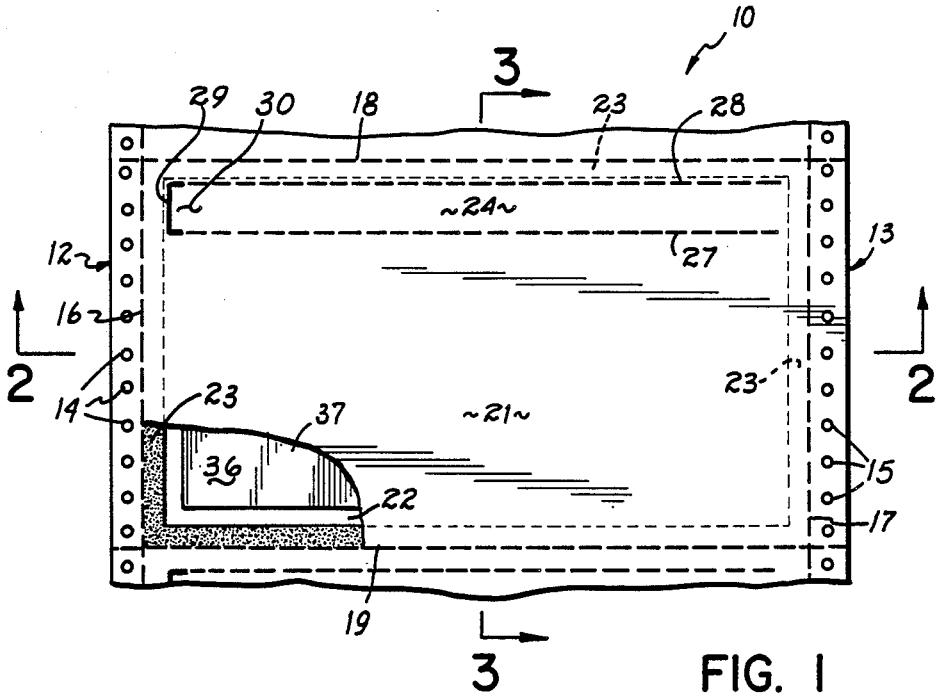
FIG. 1 is a plan view of a succession of series connected envelope assemblies according to a first preferred embodiment of the invention.

FIG. 1 shows continuous series connection of envelope assemblies 10 formed from continuous webs having longitudinally extending edges 12 and 13. Interior of the edges 12 and 13 are two rows of longitudinally extending feed holes 14 and 15, respectively. The feed holes enable the envelope assemblies 10 to be fed into a computer printer. Each envelope assembly 10 is defined longitudinally by perforation lines 16 and 17, located inboard of feed hole rows 14 and 15, respectively, and transversely by spaced perforation lines designated 18 and 19. Each envelope assembly 10 is severable along the perforation lines 16, 17, 18 and 19 to form corresponding marginal edges 16, 17, 18 and 19.

Each envelope assembly 10 comprises a closed outer envelope containing insert material held in registration therewith, the insert material including at least one open, return envelope. The outer envelope is defined by outer plies 21 and 22 shown in FIGS. 2 and 3 and FIGS. 5 and 6. According to the preferred embodiments of the invention, the outer plies 21 and 22 are secured along at least three marginal edges by a stream of non-releasable glue 23.

Figure 4:
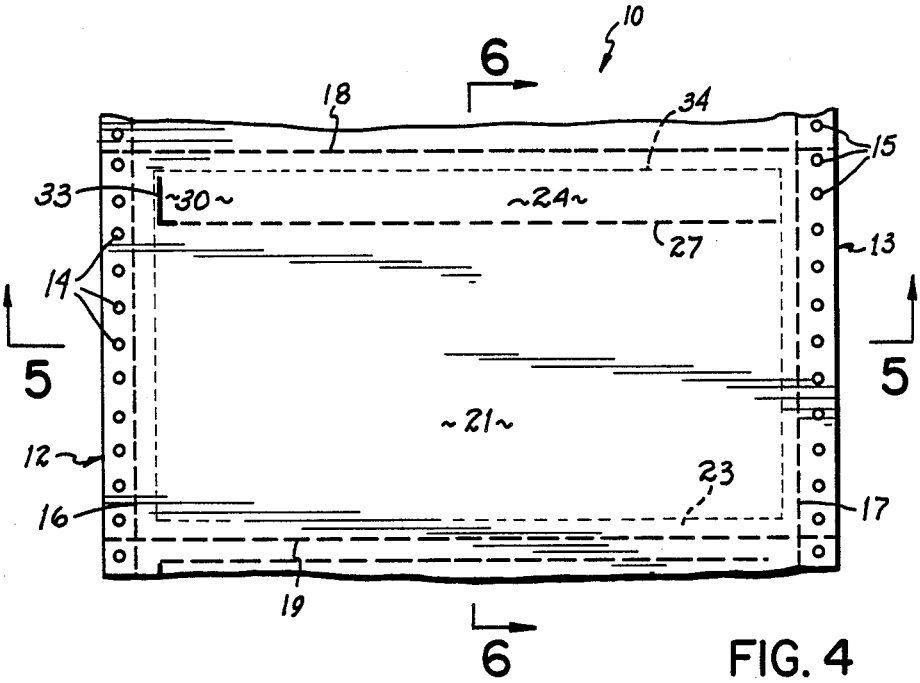
FIG. 4 is a plan view of a succession of series connected envelope assemblies according to a second preferred embodiment of the invention similar to FIG. 1, including an alternate embodiment for the insert material.

Along the fourth marginal edge, one of the outer plies has a removable pull tab 24 formed therein which enables opening of the outer envelope. The word "along" in this context means that the pull tab 24 is spaced inwardly from, and adjacent to the fourth marginal edge. Preferably, the pull tab 24 extends parallel to one of the transverse marginal edges, 18 or 19, of the envelope assembly 10, or in other words, perpendicular to the longitudinal dimension of the continuous webs. In FIGS. 1 and 4, marginal edge 18 corresponds to the fourth marginal edge.

According to a first preferred embodiment of the invention, The pull tab 24 is defined by a first tear line 27, a second tear line 28 parallel to the first tear line 27 and a U-shaped slit 29 connecting the tear lines Preferably, the tear lines 27 and 28 are parallel and each leg of the U-shaped slit 29 is aligned with one of the tear lines.

In the first preferred embodiment, the line of non-releasable glue 23 extends completely around all four marginal edges of the envelope assembly 10. As shown in FIG. 1, line 23 resides between second tear line 28 and marginal edge 18 To open the outer envelope, a portion 30 of outer ply 21 defined by the U-shaped slit 29 is grasped in one hand while the envelope assembly 10 is held along marginal edge 16 by the other hand. Pulling portion 30 will tear the pull tab 24 from the rest of the assembly 10 along lines 27 and 28, thus exposing the insert material According to the second preferred embodiment, shown in FIGS. 4, 5 and 6, the pull tab 24 is defined by the first tear line 27, an L-shaped slit 33 and a line of fugitive or releasable glue 34 extending parallel to marginal edge 18 between tear line 27 and edge 18. The releasable glue 34 holds plies 21 and 22 together along marginal edge 18 until portion 30 is grasped and pulled away from the assembly 10 to open the outer envelope.

Insert material 36 includes at least a return envelope, formed from inner plies 37 and 38, which are secured along three marginal edges by a stream of non-releasable glue 39. The plies 37 and 38 are unsecured along a fourth, open marginal edge 40. Along the open marginal edge 40, one of the inner plies includes a fold flap 42 demarcated by a line of weakening 43. The fold flap 42 has a line of activatable glue 44 located thereon and can be folded over the other of the inner plies to seal the inner envelope.

Figure 2:
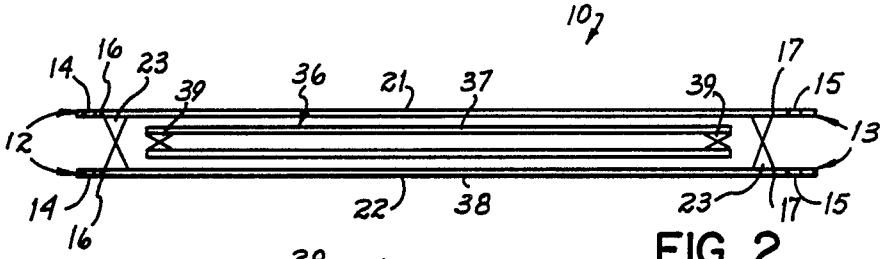
FIG. 2 is a cross-sectional view taken along lines 2—2 of FIG. 1.
Figure 5:
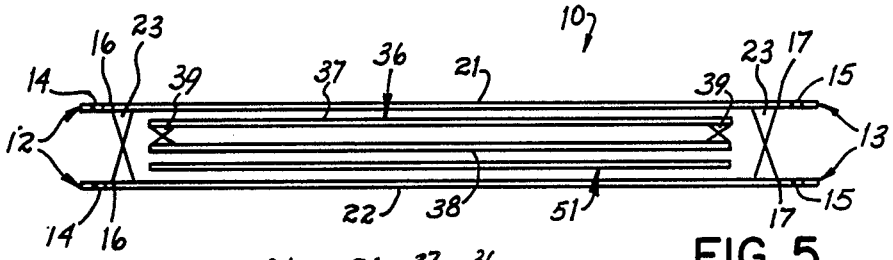
FIG. 5 is a cross-sectional view taken along lines 5—5 of FIG. 4.

Preferably, fourth open edge 40 is located proximate to the marginal edge of the outer envelope that is opposite to the pull tab 24. In FIGS. 2 and 5, the fourth open edge 40 is opposite transverse marginal edge 18 of the outer envelope. Open edge 40 may also be located proximate to a marginal edge of the outer envelope that is perpendicular or adjacent to the pull tab 24, e.g., either one of the longitudinal marginal edges 16 or 17. However, open edge 40 of the inner envelope cannot be located along the same marginal edge of the outer envelope as that of the pull tab 24. This would inhibit opening of the outer envelope.

Figure 3:
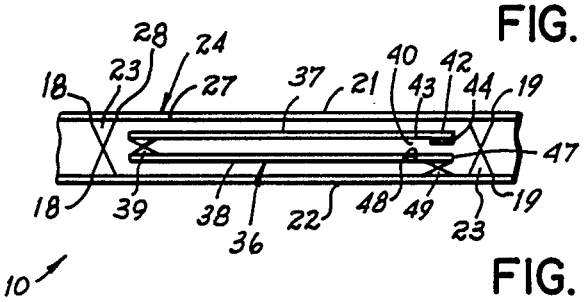
FIG. 3 is a cross-sectional view taken along lines 3—3 of FIG. 1.

Inner ply 38 has a waste flap 47 defined by a weak perforation line 48. Waste flap 47 is secured to one of the outer plies by a stream of non-releasable glue 49 to hold the inner and outer envelopes in registration. FIG. 3 shows waste flap 47 secured to outer ply 22. The insert material is unattached to the four marginal edges of the outer envelope, thereby reducing the overall thickness of the envelope assembly 10 at the marginal edges 16 and 17 and facilitating the feeding of the connected assemblies through a computer printer.

Figure 6:
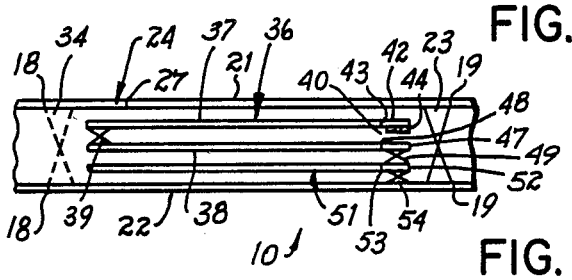
FIG. 6 is a cross-sectional view taken along lines 6—6 of FIG. 4.

FIGS. 5 and 6 show an alternate construction of the insert material 36 that can be utilized with either pull tab construction, the insert material also including an insert ply 51 which is to be removed from the outer envelope and returned within the inner envelope by the user. The insert ply 51 has a disposable flap 52 defined by weak perforation line 53. One side of this disposable flap 52 is connected to one of the outer plies of the outer envelope by a line of non-releasable glue 54, i.e., outer ply 22 in FIG. 3, while the other side of the disposable flap 52 is adhered to the waste flap 47 of the inner envelope by a line 49 of non-releasable glue.

The insert material preferably extends beyond tear line 27 in the direction of marginal edge 18 of the outer envelope, thereby facilitating grasping of the insert material in order to extract it from the outer envelope after pull tab 24 has been removed. Pulling the insert material from the outer envelope adjacent tear line 27 severs waste flap 47 and disposable flap 52 along weak perforation lines 48 and 53, respectively, and they are retained in the outer envelope.

While the above description constitutes two preferred embodiments of the invention, it is to be understood that the invention is not limited thereby and that in light of the present disclosure, various other alternative embodiments will be apparent to one of ordinary skill in the art. Accordingly, it is to be understood that changes may be made without departing from the scope of the invention as particularly set out and claimed.

We claim:

1. An envelope assembly comprising:

two outer plies sealed along at least three marginal edges by non-releasable glue to form a closed outer envelope, one of said plies having a removable pull tab formed therein adjacent a fourth marginal edge of the envelope, the pull tab adapted to enable opening of the outer envelope; and insert material within said closed outer envelope and held in registration therewith, said insert material including at least an open return envelope unattached to said outer envelope marginal edges, said return envelope having a foldable flap adapted to fold and seal said return envelope and a waste flap secured to one of said outer plies by non-releasable glue to hold said return envelope in registration with said outer envelope, said waste flap being held to said outer envelope in a position located away from said fourth marginal edge and being detachable from said insert material along a line of weakening, whereby after said outer envelope is opened by said pull tab, pulling of said insert material from said outer envelope detaches said waste flap along said line of weakening and said waste flap remains inside said outer envelope.

2. The envelope assembly of claim 1 wherein said pull tab is defined by a first tear line parallel to said fourth marginal edge, a second tear line parallel to said fourth marginal edge and extending between said first tear line and said fourth marginal edge, and a U-shaped slit having two legs, each leg of said U-shaped slit aligned with one of said tear lines, the envelope assembly further comprising:

a line of non-releasable glue between said second tear line and said fourth marginal edge for securing said outer plies along said fourth marginal edge.

3. The envelope assembly of claim 1 wherein said pull tab is defined by a first tear line parallel to said fourth marginal edge and an L-shaped slit, one leg of said L-shaped slit aligned with said tear line, the envelope assembly further comprising:

a line of releasable glue between said fourth marginal edge and said tear line for securing said outer plies together along said fourth marginal edge.

4. The envelope assembly of claim 1 wherein said waste flap is secured to one of said outer plies of said outer envelope proximate a marginal edge that is opposite to said fourth marginal edge.

5. The envelope assembly of claim 1 wherein said waste flap is secured to one of said outer plies of said outer envelope proximate a marginal edge that is adjacent to said fourth marginal edge.

6. The envelope assembly of claim 2 or 3 wherein said insert material extends in the direction of said fourth marginal edge beyond said first tear line.

7. A continuous series of envelope assemblies of the type recited in claim 1, comprising:

two longitudinally extending continuous webs having two longitudinally directed marginal edges and two rows of longitudinally extending spaced feed holes located inboard of said marginal edges, said webs further having longitudinally extending perforation lines located inboard of said feed holes, said webs having uniformly spaced transversely extending perforation lines to demarcate transverse marginal edges of a series of separable envelope assemblies, the longitudinally extending perforation lines demarcating the longitudinal marginal edges of the separable envelope assemblies.

* * * * *